US006811715B2

(12) United States Patent
Suzuki

(10) Patent No.: US 6,811,715 B2
(45) Date of Patent: Nov. 2, 2004

(54) METHOD FOR PRODUCING INK JET RECORDING HEAD, AND INK JET RECORDING HEAD PRODUCED BY SUCH METHOD

(75) Inventor: Toshio Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 10/079,898

(22) Filed: Feb. 22, 2002

(65) Prior Publication Data

US 2002/0119248 A1 Aug. 29, 2002

(30) Foreign Application Priority Data

Feb. 22, 2001 (JP) ..... 2001-047082

(51) Int. Cl.[7] ..... B41J 2/16
(52) U.S. Cl. ..... 216/27; 347/64; 347/65
(58) Field of Search ..... 216/27; 347/64, 347/65

(56) References Cited

U.S. PATENT DOCUMENTS

| | | | | |
|---|---|---|---|---|
| 4,657,631 A | | 4/1987 | Noguchi | 156/655 |
| 5,347,713 A | | 9/1994 | Shibata et al. | 29/890.1 |
| 5,491,505 A | | 2/1996 | Suzuki et al. | 347/203 |
| 5,524,784 A | | 6/1996 | Shiba et al. | 216/27 |
| 5,649,359 A | | 7/1997 | Murakami et al. | 29/890.1 |
| 5,703,630 A | | 12/1997 | Murakami et al. | 347/45 |
| 5,724,784 A | | 3/1998 | Menchetti | 52/483.1 |
| 6,041,501 A | | 3/2000 | Suzuki et al. | 29/890.1 |
| 6,055,729 A | | 5/2000 | Suzuki | 29/890.1 |
| 6,084,612 A | | 7/2000 | Suzuki et al. | 347/50 |
| 6,110,544 A | | 8/2000 | Yang et al. | 427/580 |
| 6,241,335 B1 | | 6/2001 | Suzuki | 347/20 |
| 6,331,259 B1 | * | 12/2001 | Ozaki et al. | 216/27 |
| 6,472,125 B1 | * | 10/2002 | Koide et al. | 430/320 |
| 6,508,538 B2 | * | 1/2003 | Suzuki et al. | 347/43 |
| 6,561,623 B1 | * | 5/2003 | Aono et al. | 347/45 |
| 2001/0008907 A1 | | 7/2001 | Imamura | 522/181 |

FOREIGN PATENT DOCUMENTS

| | | | | |
|---|---|---|---|---|
| JP | 58224758 A | * | 12/1983 | B41J/3/04 |
| JP | 61-154947 A | | 7/1986 | B41J/3/04 |
| JP | 06-008437 A | | 1/1994 | B41J/2/05 |
| JP | 06-191036 A | | 7/1994 | B41J/2/05 |
| JP | 10-053639 A | | 2/1998 | C08G/59/30 |
| JP | 11-071681 A | | 3/1999 | C23C/16/50 |

* cited by examiner

*Primary Examiner*—Anita Alanko
(74) *Attorney, Agent, or Firm*—Fitzpatrick, Cella, Harper & Scinto

(57) ABSTRACT

A method for producing an ink jet recording head, comprising steps of forming, on a substrate, a solid layer composed of soluble resin and having a pattern for constituting a liquid flow path; forming an inorganic film by low temperature film formation so as to cover the solid layer; forming a layer of a head forming material so as to cover the inorganic film; removing a part of the inorganic film for forming a discharge port; and removing the solid film thereby forming a liquid flow path communicating with the discharge port.

12 Claims, 11 Drawing Sheets

FIG. 8A1
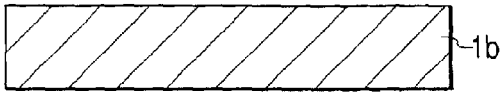
FIG. 8A2
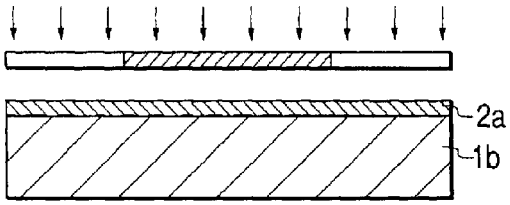
FIG. 8A3
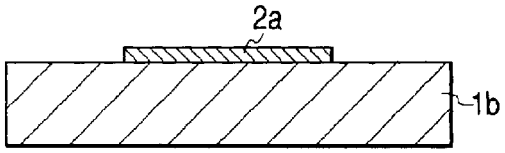
FIG. 8A4
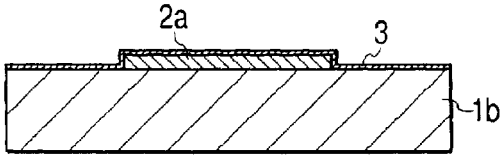
FIG. 8A5
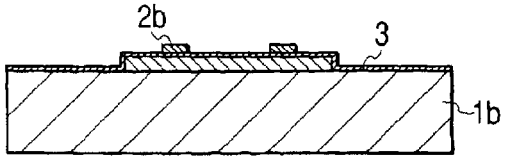
FIG. 8A6
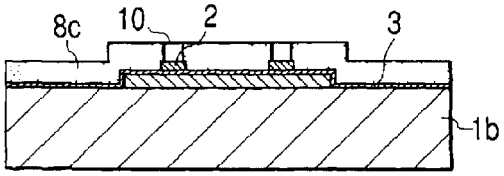
FIG. 8A7
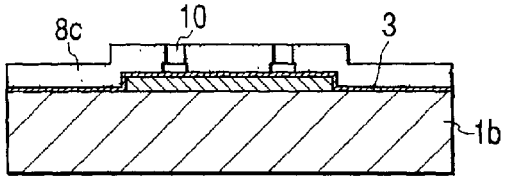
FIG. 8A8
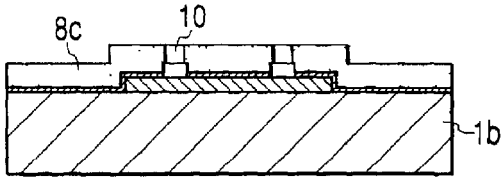
FIG. 8A9
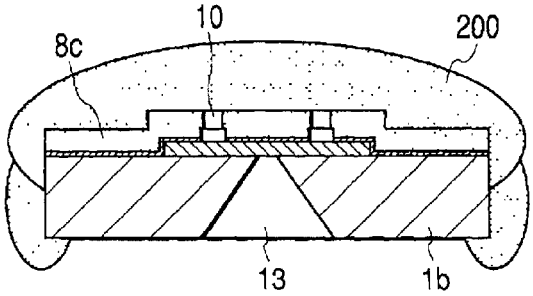
FIG. 8A10
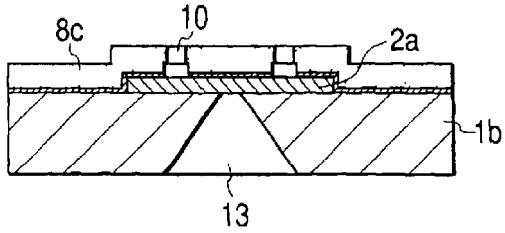
FIG. 8A11
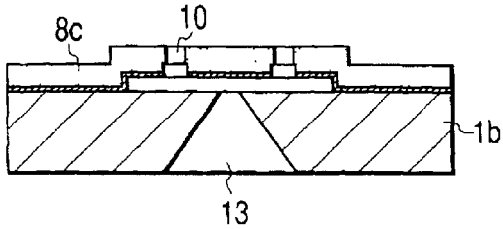

FIG. 9A1
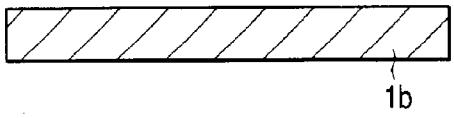
FIG. 9A2
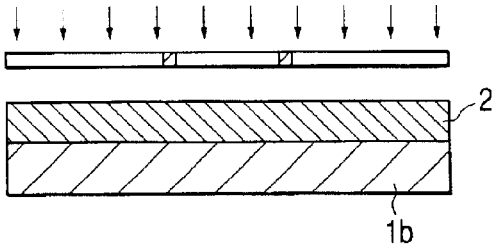
FIG. 9A3
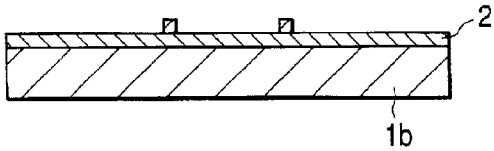
FIG. 9A4
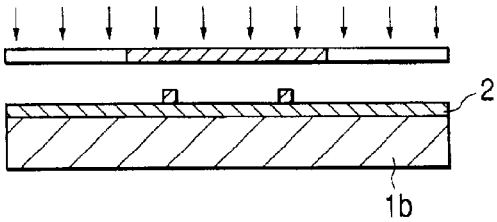
FIG. 9A5
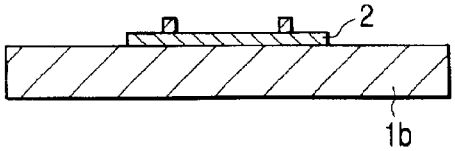
FIG. 9A6
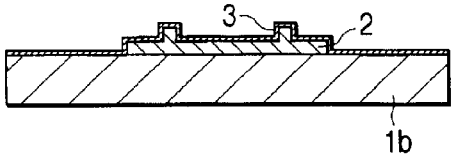
FIG. 9A7
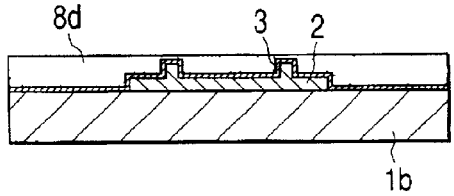
FIG. 9A8
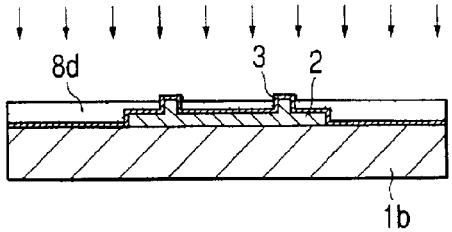
FIG. 9A9
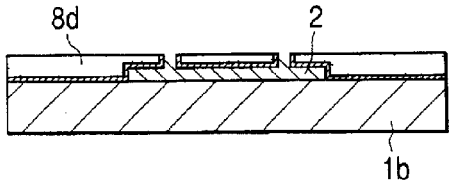
FIG. 9A10
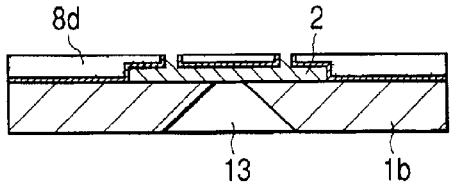
FIG. 9A11
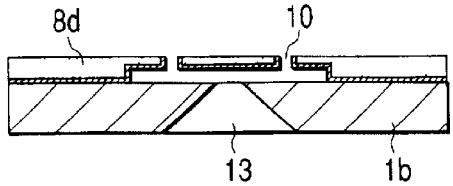

METHOD FOR PRODUCING INK JET RECORDING HEAD, AND INK JET RECORDING HEAD PRODUCED BY SUCH METHOD

BACKGROUND OF THE INVENTION

1. Field of the Invention

The present invention relates to a method for producing an ink jet recording head, and to an ink jet recording method produced by such method.

2. Related Background Art

The ink jet recording head, employed in the ink jet recording method (liquid jet recording method), is generally provided with a fine recording liquid discharge port (hereinafter called orifice), a liquid flow path and a liquid discharge energy generating portion provided in a part of the liquid flow path, all in plural units. As one of the conventional methods for producing such ink jet recording head, the Japanese Patent Application Laid-open No. 61-154947 discloses a method forming a liquid flow path pattern with soluble resin, then covering such pattern with epoxy resin or the like, hardening the covering resin, and eliminating the soluble resin pattern by dissolution after the substrate is cut.

On the other hand, the material constituting the liquid flow path of the ink jet recording head is required to have a high mechanical strength as the structural material, satisfactory adhesion to the substrate, satisfactory ink resistance and a high resolving power for forming a fine pattern of the discharge ports.

However, with the recent progress in the ink toward higher performance, it is being found sometimes difficult to meet all these requirements, and the peeling from the substrate is sometimes encountered particularly in case of a long-sized head or the like. Also meeting all these requirement may limit the selection of the material itself and may reduce the tact at the manufacture.

Separately, the periphery of the discharge port preferably has ink repellent property, but such property is provided by an ink repellent layer formed around the discharge port and is generally deficient in the abrasion resistance and in the adhesion to the substrate. It is also possible to form the flow path forming member itself with an ink repellent material, but, in such case, the interior of the liquid flow path has to be made hydrophilic. As a method for hydrophilizing the interior of the flow path, the Japanese Patent Application Laid-open No. 6-191036 discloses a method of forming the wall of the liquid flow path with water repellent resin and hydrophilizing the internal surface of the liquid flow path for example by an ashing process.

The method disclosed in the Japanese Patent Application Laid-open No. 6-191036 will be outlined with reference to FIGS. 10A to 10I.

In order to stabilize the ink discharge direction and to improve the durability, a liquid flow path end forming groove 103 is provided on a substrate 101 as shown in FIG. 10A, and a water-repellent settable resin layer 105 is formed therein as shown in FIG. 10B. Then a belt like-shaped solid layer 106 composed of soluble resin is formed thereon, and a water-repellent settable resin layer 113 is coated thereon as shown in FIG. 10C, and a top plate 107 is placed as shown in FIG. 10D. Then, as shown in FIG. 10E, the pattern of the water-repellent settable resin layer 113 is hardened by the irradiation with active energy ray, and an unhardened portion 113*a* is removed as shown in FIG. 10F to form a part of a liquid chamber 114. Then cutting is executed along the position of the water-repellent settable resin layer 105 shown in FIG. 10F to form a discharge port face 119 as shown in FIG. 10G, and the aforementioned solid layer is dissolved out to form a liquid flow path 115 and a discharge port 116 as shown in FIG. 10H. Then, as shown in FIG. 10I, the liquid flow path 115 and the liquid chamber 114 are subjected to a hydrdophilizing process to form a hydrophilic film 117. In this manner, the discharge port face 119 can be composed of water-repellent settable resin of a uniform material.

However, such method is difficulty in control in order to obtain uniform hydrdophilicity on the internal wall to be hydrophilized.

SUMMARY OF THE INVENTION

In consideration of the foregoing, an object of the present invention is to provide a method for producing an ink jet recording head, capable of avoiding peeling of the flow path forming material from the substrate even in case of a long-sized head, and enabling satisfactory range of material selection and satisfactory productivity.

Another object of the present invention is to provide a method for producing an ink jet recording head showing excellent durability of the hydrophilic film in the liquid flow path and of the water repellency on the discharge port face.

The above-mentioned objects can be attained, according to the present invention, by a method for producing an ink jet recording head, comprising steps of:

- forming, on a substrate, a solid layer consisting of soluble resin and having a pattern to constitute a liquid flow path;
- forming an inorganic film by low temperature film formation so as to cover the solid layer;
- forming a layer of a material constituting the head so as to cover the inorganic film;
- removing a part of the inorganic film in order to form a discharge port; and
- removing the solid layer to form a liquid flow path communicating with the discharge port.

In such method, the layer of the head constituting material may be composed of an ink repellent material to achieve uniformity of the interior of the flow path at the same time.

BRIEF DESCRIPTION OF THE DRAWINGS

FIGS. 8A1, 8A2, 8A3, 8A4, 8A5, 8A6, 8A7, 8A8, 8A9, 8A10 and 8A11 are views showing steps of a process for producing an ink jet recording head of side shooter type of example 4;

FIGS. 9A1, 9A2, 9A3, 9A4, 9A5, 9A6, 9A7, 9A8, 9A9, 9A10 and 9A11 are views showing steps of a process for producing an ink jet recording head of side shooter type of example 5;

DESCRIPTION OF THE PREFERRED EMBODIMENTS

Figure 7A:
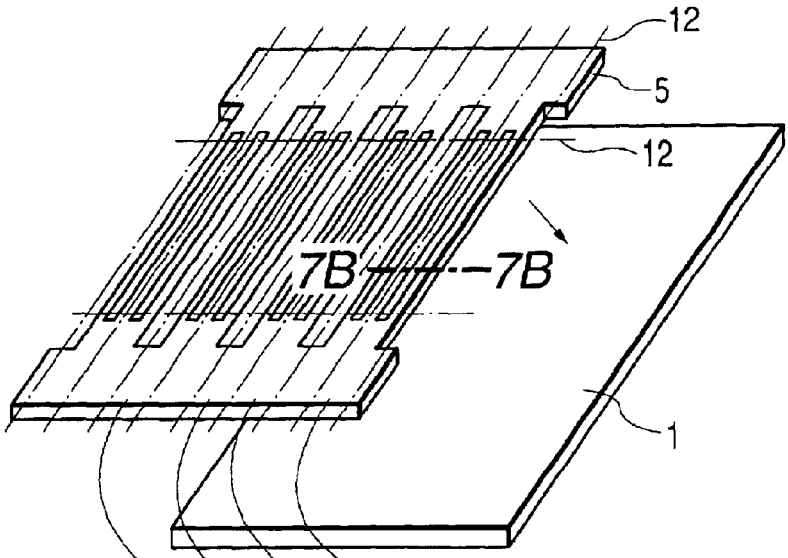
FIG. 7A is a perspective view showing preparation of plural ink jet recording heads of edge shooter type.
Figure 7B:
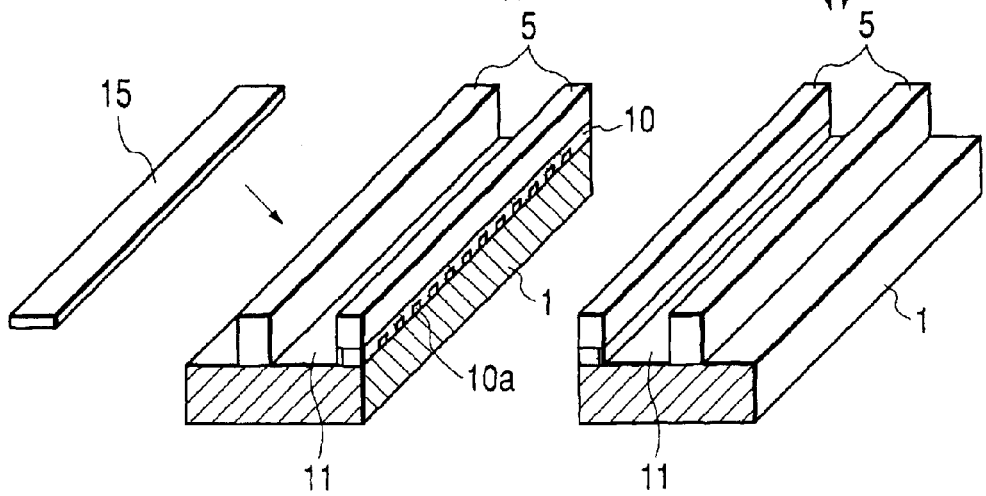
FIG. 7B is a perspective view showing an ink jet recording head obtained by the process shown in FIG. 7A.

FIGS. 7A and 7B are perspective views showing the basic configuration of the ink jet recording head of edge shooter type of the present invention.

FIG. 7A is a perspective view showing preparation of plural ink jet recording heads of edge shooter type and FIG. 7B is a perspective view showing an ink jet recording head obtained by the process shown in FIG. 7A. Referring to FIG. 7A, a substrate 1 and a top plate 5 are adjoined, and are cut along cutting lines 12 to obtain a head shown in FIG. 7B in plural units.

A substrate 1 is provided with a heat accumulation layer, a heater etc., and FIG. 7A shows a configuration in which substrates corresponding to plural heads are formed in continuation.

A top plate 5 forms a common liquid chamber 11 and a liquid flow path (not shown) by being adjoined to the substrate 1. A cover 15 closes a portion above the common liquid chamber of the top plate.

The liquid flow path communicates with the common liquid chamber at an end and with a discharge port 10*a* at the other end. A heater provided in the liquid flow path provides the liquid therein with thermal energy thereby discharging the liquid from the discharge port.

In the following the head producing method of the present invention will be outlined.

At first, on the substrate, there is formed a solid layer consisting of soluble resin and having a pattern for constituting the liquid flow path. The resin employed for forming the solid layer photoresist MF-58, ODUR1010A and the like supplied by Tokyo Ohka Kogyo Co., Ltd. can be utilized.

Then an inorganic film is formed by low temperature film formation so as to cover the solid layer. Such inorganic film serves as a film separating the ink from the head forming material, so that the head forming material can be selected from various materials.

In the present invention, since the inorganic film is formed by low temperature film formation, there can be formed a satisfactory liquid flow path excellent in ink resistance without deteriorating the shape of the solid layer present thereunder.

Such low temperature film formation can be achieved, for example, by sputtering, plasma CVD, evaporation electroforming, and so on.

Also the material for forming such inorganic film by the low temperature film formation can be SiN, $SiO_2$, $Al_2O_3$, Ti, Ta, Cu, Ag, ITO or the like. Since the aforementioned inorganic film is generally hydrophilic, the interior of the liquid flow path need not be hydrophilized anew even if the head forming material is composed of an ink repellent material. Besides, the inorganic film provides an advantage of providing uniform hydrophilicity in the liquid flow path.

Then there is formed a layer of the head forming material so as to cover the aforementioned inorganic film.

The head forming material can be composed of a resinous material as explained in the foregoing, and such resinous material can also be ink repellent. Furthermore, photosensitive resin may be employed for forming the discharge port by a photolithographic process, whereby the discharge port can be prepared with a high precision.

Also the layer of the head forming material can be composed of an inorganic material. In case of employing an inorganic material for this purpose with a large thickness in the conventional configuration, there is required a very long time for film formation in order to maintain satisfactory film quality, but, in the above-described configuration, the head forming material is not required to have such high film quality because the ink comes into contact only with the aforementioned inorganic film, so that head forming material can be formed at a high speed for example by a high speed arc plasma CVD, electroforming or the like.

Then a part of the aforementioned inorganic film is removed in order to form the discharge port. In case of edge shooter type, the inorganic film is removed by cutting thereof together with the substrate. In portions other than the discharge port (for example in the common liquid chamber), the inorganic film is removed by dry etching.

In case of side shooter type, the inorganic film is removed by dry etching in a portion where the discharge port is to be formed. In case the layer of the head forming material is composed of a resinous material, the inorganic film may be selectively removed since the etching rate can be significantly different between the resinous material and the inorganic film.

Finally the solid layer is removed to form the liquid flow path communicating with the discharge port, thereby completing the recording head.

In the following, the present invention will be explained by plural examples with reference to the respectively accompanying drawings, but the present invention is not limited by such examples but includes any and all embodiments falling within the scope of the appended claims.

EXAMPLE 1

Method for Producing a First Ink Jet Recording Head of Edge Shooter Type

Figure 1A:
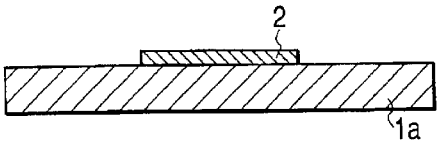
FIGS. 1A, 1B, 1C, 1D, 1E, 1F, 1G, 1H, 1I, 1J and 1K are views showing steps of a process for producing an ink jet recording head of edge shooter type of example 1.
Figure 1B:
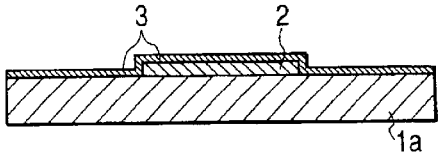
Figure 1C:
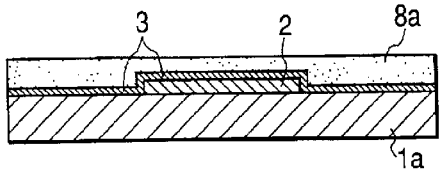
Figure 1D:
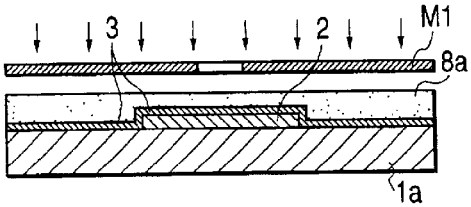
Figure 1E:
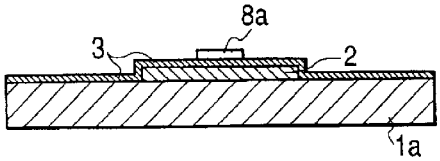
Figure 1F:
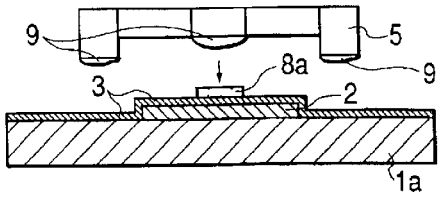
Figure 1G:
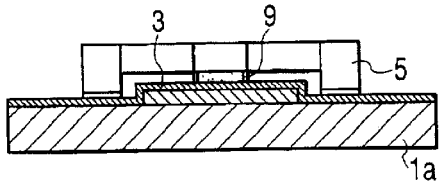
Figure 1H:
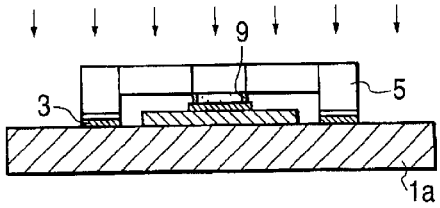
Figure 1I:
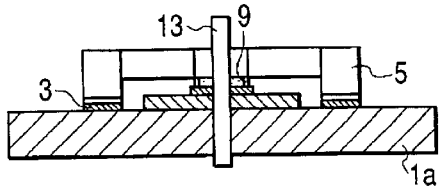
Figure 1J:
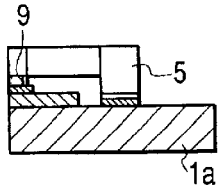
Figure 1K:
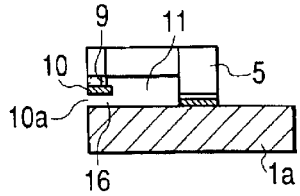
Figure 2:
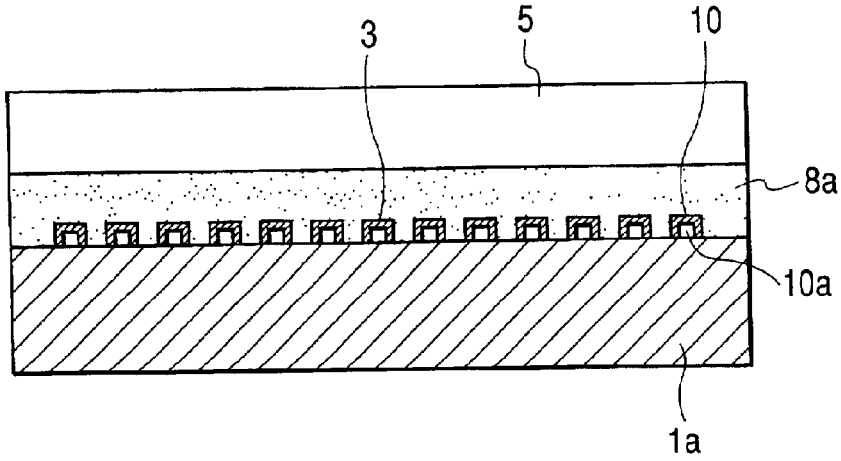
FIG. 2 is a view showing a discharge port face of the ink jet recording head obtained by the process shown in FIGS. 1A, 1B, 1C, 1D, 1E, 1F, 1G, 1H, 1I, 1J and 1K.

Another example of the ink jet recording head of edge shooter type is shown in FIGS. 1A to 1K and 2, in which FIGS. 1A to 1K show process steps for producing the head in cross-sectional views along a line 7B—7B in FIG. 7A, and FIG. 2 is a view showing the discharge port face of the completed ink jet recording head.

At first, on an aluminum substrate 1*a* bearing a heat accumulation layer and heaters, a solid layer 2 consisting of positive photoresist was formed with a thickness of 20 $\mu$m and selectively by patterning in positions where the liquid flow path and the liquid chamber were to be formed (FIG. 1A).

Then a hydrophilic film 3 consisting of $SiO_2$ was formed with a thickness of 0.2 μm by sputtering, so as to cover the solid layer 2. The film formation was executed with an MRC sputtering apparatus model 603, with an electric power of 2 kW. The substrate was not heated in order to avoid fusion of the solid layer 2 (FIG. 1B).

The hydrophilic film 3 is illustrated thicker than the actual dimension in order to clarify the configuration (hereinafter similar method being adopted).

Then water-repellent settable resin was coated with a thickness of 30 μm so as to cover the hydrophilic film 3.

For this water-repellent settable resin, there was adopted photosensitive water-repellent resin 8*a* capable of providing water repellency and hardenable by active energy ray, as disclosed in the Japanese Patent Application Laid-open No. 10-53639 (FIG. 1C).

Then exposure was executed through a mask M1, excluding a central portion of a width of 1.8 mm. The exposure was made with a Canon mask aligner MPA600 with an exposure amount of 4 J/cm$^2$ (FIG. 1D).

Then, after heating for 45 minutes at 90° C. in an oven, the unexposed portion was dissolved out with methyl isobutylketone. Then heating was further executed for 1 hour at 100° C. to obtain a photosensitive water-repellent resin layer 8*a* of a width of 1.8 mm at the center (FIG. 1E).

Then, an aluminum top plate 5 having a central portion of a thickness of 0.97 mm and a width of 2.0 mm, and an end portion of a thickness of 1.0 mm and a width of 1.1 mm and subjected to an anticorrosion treatment is coated, at the center and both ends, with resin 9, settable at normal temperature, with a dispenser (FIG. 1F).

The coating was executed with a coating speed of 30 mm/sec, a syringe G23, a distance of 0.1 mm between the syringe and the substrate, an end coating pressure of 0.6 kg/cm$^2$, and a central coating pressure of 0.4 kg/cm$^2$. The resin 9 settable at normal temperature was composed of a mixture of 100 parts by weight of Epicote 828 supplied by Yuka Shell Epoxy Co. and 50 parts by weight of Fujicure 6010 supplied by Fuji Chemical Industries, Co.

The aluminum top plate 5 coated with the normal temperature-settable resin 9 was adjoined to the aluminum substrate 1*a* (FIG. 1F).

In this adjoining operation, since the photosensitive water-repellent resin layer 8*a* had a width of 1.8 mm while the central portion of the aluminum top plate 5 had a width of 2.0 mm, the normal temperature-settable resin 9 coated on the aluminum top plate 5 covers the lateral face of the photosensitive water-repellent resin layer 8*a*. Thereafter hardening was executed for 1 hour at 100° C. (FIG. 1G).

Then $SiO_2$ was dry etched by RIE (reactive ion etching) employing $CHF_3$ at 16 sccm, $C_2F_6$ at 24 sccm and $O_2$ at 5 sccm at a pressure of 0.02 Torr and an electric power of 900 W (FIG. 1H).

Then the center was cut off by a diamond bite of a blade width of 1.0 mm (FIG. 1I).

In this manner a single head was separated (FIG. 1J).

Then the solid layer 2 was removed with ethyl cellosolve to form the liquid flow path 16, common liquid chamber 11, discharge port 10*a* and discharge port face 10 (FIG. 1K).

FIG. 2 shows thus prepared head, observed from the left side in FIG. 1K. The hydrophilic film 3, though illustrated thicker for the purpose of clarity, is scarcely visible as the thickness thereof is only about 0.2 μm, and also scarcely affects the water repellency of the discharge port face 10.

In this manner there can be produced an ink jet recording head in which the discharge port face is formed between the photosensitive water-repellent resin layer 8*a* and the aluminum substrate 1*a* and along an end face thereof. The internal wall of the discharge port 10*a* is provided with the hydrophilic film 3 and the internal wall of the common liquid chamber 11 is also rendered hydrophilic.

EXAMPLE 2

Method for Producing a Second Ink Jet Recording Head of Edge Shooter Type

Figure 3A:
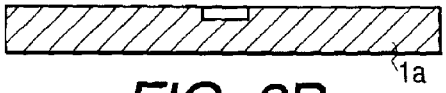
FIGS. 3A, 3B, 3C, 3D, 3E, 3F, 3G, 3H, 3I, 3J and 3K are views showing steps of a process for producing an ink jet recording head of edge shooter type of example 2.
Figure 3B:
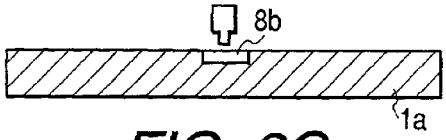
Figure 3C:
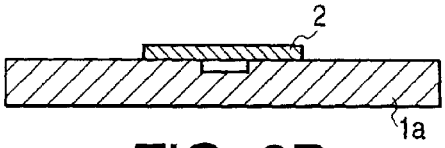
Figure 3D:
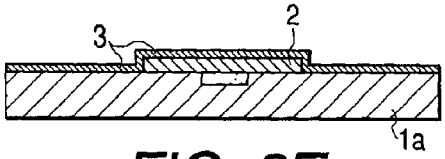
Figure 3E:
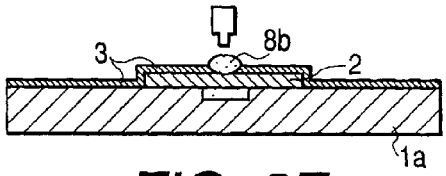
Figure 3F:
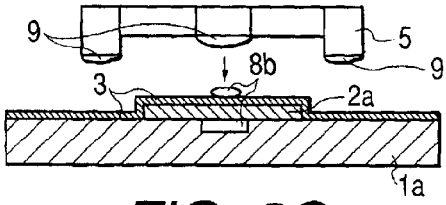
Figure 3G:
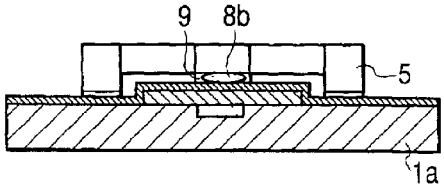
Figure 3H:
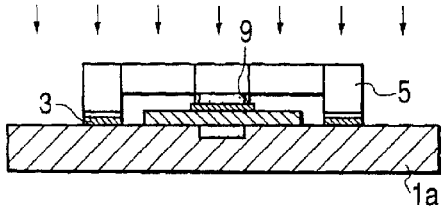
Figure 3I:
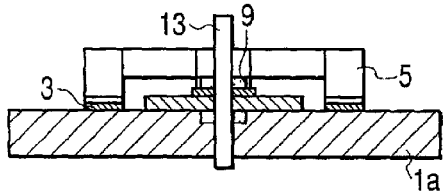
Figure 3J:
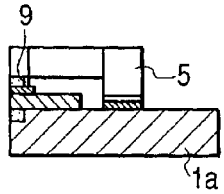
Figure 3K:
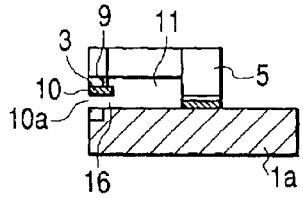
Figure 4:
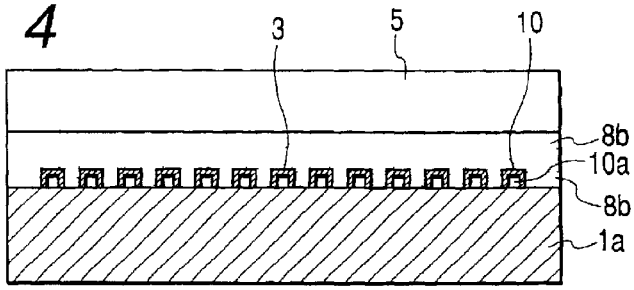
FIG. 4 is a view showing a discharge port face of the ink jet recording head obtained by the process shown in FIGS. 3A, 3B, 3C, 3D, 3E, 3F, 3G, 3H, 3I, 3J and 3K.

Another example of the ink jet recording head of edge shooter type is shown in FIGS. 3A to 3K and 4, in which FIGS. 3A to 3K show process steps for producing the head in cross-sectional views along a line 7B—7B in FIG. 7A, and FIG. 4 is a view showing the discharge port face of the completed ink jet recording head.

In contrast to the foregoing example 1 utilizing the photosensitive water-repellent resin 8*a* as the water-repellent settable resin, the present example employs water-repellent resin 8*b* lacking photosensitivity. Such water-repellent resin 8*b* without photosensitivity is provided also on the lower side of the discharge port 10*a*.

At first, in the central portion of an aluminum substrate 1*a*, a groove of a depth of 20 um and a width of about 1.2 mm was formed by a diamond bite (FIG. 3A).

Then water-repellent resin 8*b* without photosensitivity was filled into the groove by a dispenser (FIG. 3B).

The hydrophilic film 3 is illustrated thicker than the actual dimension in order to clarify the configuration (hereinafter similar method being adopted).

The water-repellent resin was composed of a mixture of 50 parts by weight of Epicote 828 supplied by Yuka Shell Epoxy Co., 30 parts by weight of 1,3-bis(3-glycidoxypropyl)tetramethyldisiloxane, 20 parts by weight of 3-(2-perfluorohexyl)ethoxy-1,2-epoxypropane, 5 parts by weight of NUC silane coupling agent A-187 supplied by Nippon Unicar Co., and 1.5 parts by weight of ADECA optomer SP-170 supplied by Asahi Denka Kogyo Co.

Then, hardening was executed for 1 hour at 130° C. Thereafter, there were formed heat accumulation layers, heaters, wirings etc. which are not illustrated.

Then, as in the example 1, a solid layer 2 consisting of positive photoresist was formed with a thickness of 20 μm and patterned (FIG. 3C).

Then a hydrophilic film 3 consisting of $SiO_2$ was formed with a thickness of 0.2 μm by sputtering under the same conditions as in the example 1 (FIG. 3D).

Then the aforementioned water-repellent resin 8*b* without photosensitivity was coated with a dispenser under the conditions of a coating speed of 30 mm/sec, a syringe G23, a distance of 0.1 mm between the syringe and the substrate, and an end coating pressure of 0.4 kg/cm$^2$. Then, hardening was executed for 1 hour at 130° C. (FIG. 3E).

The subsequent steps shown in FIGS. 3F to 3K are substantially same as those of the foregoing example 1 shown in FIGS. 1F to 1K and will not therefore be explained further.

FIG. 4 shows thus prepared head, observed from the left side in FIG. 3K.

The ink jet recording head shown in FIG. 4 is different from that shown in FIG. 2 in that the water-repellent resin 8*b* without photosensitivity is employed as the water-repellent settable resin and also is provided on the lower side of the discharge port face 10.

In this manner there can be produced an ink jet recording head in which the discharge port face is composed of the water-repellent settable resin and formed along an end face of the aluminum substrate 1*a*. Since all the periphery of the discharge port face 10 is composed of same resin, there can be obtained uniform wettability to increase the stability of liquid discharge.

EXAMPLE 3

Method for Producing a First Ink Jet Recording Head of Side Shooter Type

An example 3 is shown in FIGS. 5A to 5K and 6.

Figure 5A:
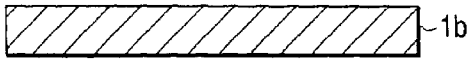
FIGS. 5A, 5B, 5C, 5D, 5E, 5F, 5G, 5H, 5I, 5J and 5K are views showing steps of a process for producing an ink jet recording head of edge shooter type of example 3.

At first, instead of the aluminum substrate 1*a* in the foregoing first or second example, there was employed a silicon substrate 1*b* bearing wirings, heaters and heat accumulation layers (FIG. 5A).

Then patterning was performed by a multi-step exposure method disclosed in the Japanese Patent Application Laid-open No. 6-8437.

Figure 5B:
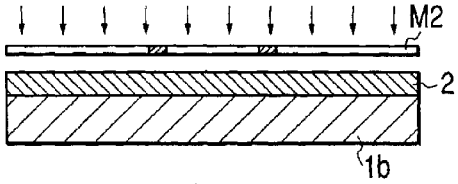

Positive photoresist AZ-4903 (Hoechst) was spin coated with a thickness of 40 $\mu$m and was prebaked for 40 minutes at 90° C. in an oven to form a solid layer 2. The solid layer 2 was subjected to a pattern exposure through a mask M2 of the nozzle pattern, by a Canon mask aligner PLA-501 with an exposure amount of 800 mJ/cm$^2$ (FIG. 5B).

Figure 5C:
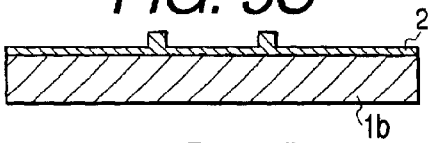

The photoresist was developed with 0.75 wt. % aqueous solution of sodium hydroxide, then rinsed with ion exchanged water and postbaked for 30 minutes at 50° C. in a vacuum oven to obtain a solid layer 2 developed to a depth of 20 $\mu$m (FIG. 5C).

Figure 5D:
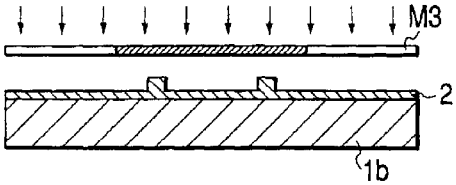

Then pattern exposure was executed through another mask M3, again with an exposure amount of 800 mJ/cm (FIG. 5D).

Figure 5E:
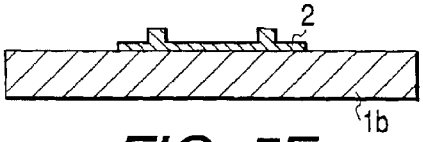

The photoresist was developed with 0.75 wt. % aqueous solution of sodium hydroxide, then rinsed with ion exchanged water and postbaked for 30 minutes at 70° C. in a vacuum oven to obtain a solid layer 2 (FIG. 5E).

Figure 5F:
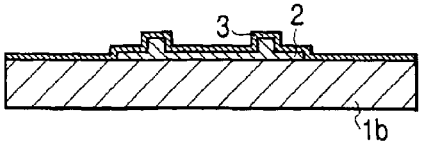

Then an $SiO_2$ film of a thickness of 2 $\mu$m under the same conditions as in the foregoing examples 1 and 2 (FIG. 5F).

Figure 5G:
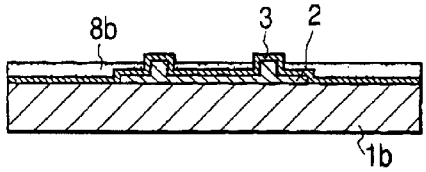

Then the water-repellent resin 8*b* without photosensitivity, same as that employed in the example 2, was coated with a thickness of 30 $\mu$m. Then, hardening was executed for 1 hour at 130° C. (FIG. 5G).

Figure 5H:
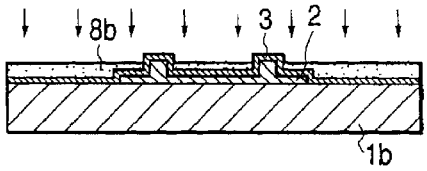

Then the $SiO_2$ film was dry etched by RIE (reactive ion etching) as in the foregoing examples 1 and 2 (FIG. 5H).

Figure 5I:
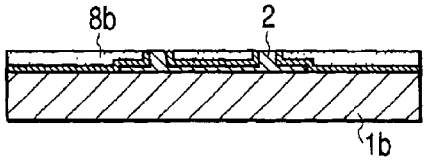

In this manner the surfacial $SiO_2$ film was etched in the most protruding portion of the photoresist (FIG. 5I).

Figure 5J:
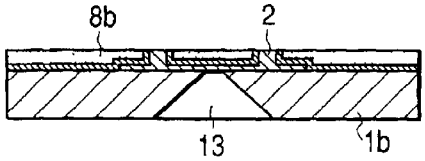

Then the ink supply aperture 13 was formed by anisotropic etching from the rear side of the silicon substrate 1*b* (FIG. 5J).

Figure 5K:
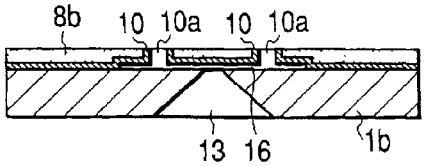

Then the substrate was immersed in 3.0 wt. % aqueous solution of sodium hydroxide to dissolve the solid layer 2 to form the liquid flow path 16, discharge port 10*a* and discharge port face 10 (FIG. 5K).

Figure 6:
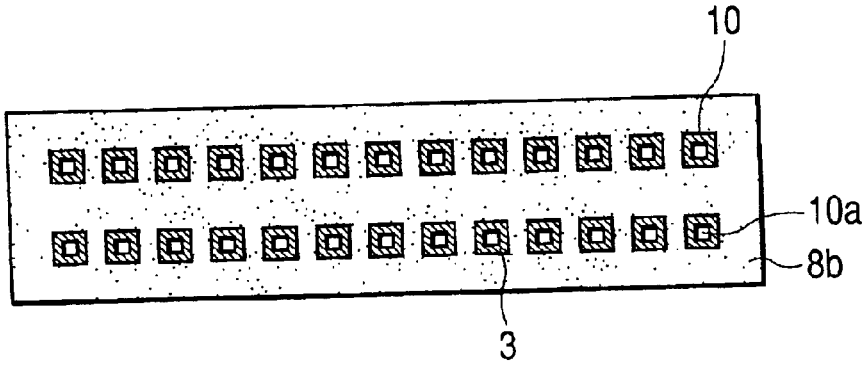
FIG. 6 is a view showing a discharge port face of the ink jet recording head obtained by the process shown in FIGS. 5A, 5B, 5C, 5D, 5E, 5F, 5G, 5H, 5I, 5J and 5K.

FIG. 6 shows thus prepared head, observed from above.

In this manner there can be produced an ink jet recording head in which the discharge port face 10 is formed in the water-repellent settable resin layer above the silicon substrate 1*b*, and which is a side shooter ink jet recording head wherein the internal wall of the discharge port 10*a* alone is covered by the hydrophilic film 3.

EXAMPLE 4

Method for Producing a Second Ink Jet Recording Head of Side Shooter Type

An example 4 is shown in FIGS. 8A1 to 8A11 and 8B.

At first, there was employed a silicon substrate 1*b* bearing wirings, heaters and heat accumulation layers (FIG. 8A1).

Then similarly to Example 1, a photoresist MF-58 supplied by Tokyo Ohka as a solid layer 2*a* is coated with a thickness of 20 $\mu$m and is subjected to exposure (FIG. 8A2).

The solid layer 2*a* is remained at a portion where a liquid chamber is planed (FIG. 8A3).

Next, similarly to the examples 1 to 3, a Cu film 3 with a film thickness of 0.2 $\mu$m was formed by sputtering (FIG. 8A4).

Further, similarly to FIG. 8A2, as a solid layer MF-58 is coated with a thickness of 5 $\mu$m and patterning is made so as to leave only a discharge port forming portion (FIG. 8A5), where a Nickel is laminated with a thickness of 20 $\mu$m to form a head constituting material 8*c* (FIG. 8A6).

Solid layer 2*b* is removed by ethyl cellosolve (FIG. 8A7).

Cu film 3 below a discharge port 10 is etched by ammonium persulfate (FIG. 8A8).

A head surface is covered with a rubber resist OBC supplied by Tokyo Ohka as a protection film 200 and anisotropy etching is performed from a reversed side of silicon substrate (FIG. 8A9) to form an ink supply opening 13 (FIG. 8A9).

OBC is removed by a xylene (FIG. 8A10).

Solid layer 2*a* is removed by an ethyl cellosolve (FIG. 8A11).

Figure 8B:
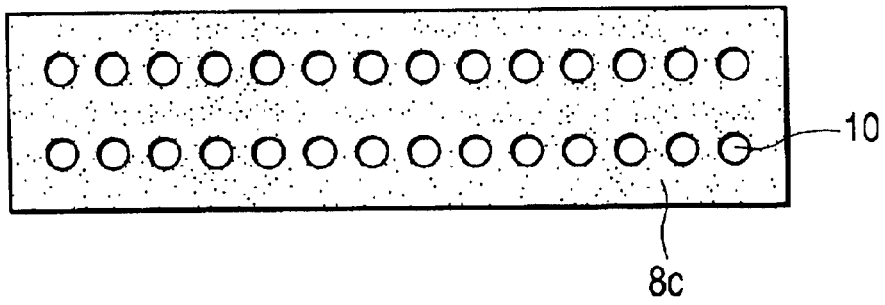
FIG. 8B is a view showing a discharge port face of the ink jet recording head obtained by the process shown in FIGS. 8A1, 8A2, 8A3, 8A4, 8A5, 8A6, 8A7, 8A8, 8A9, 8A10 and 8A11.

FIG. 8B illustrates a view observed from above.

EXAMPLE 5

Method for Producing a Third Ink Jet Recording Head of Side Shooter Type

Figure 9B:
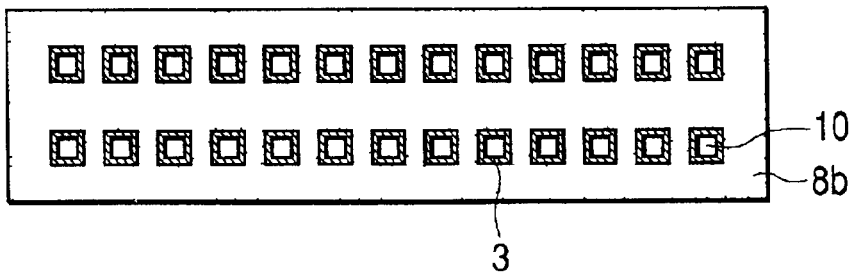
FIG. 9B is a view showing a discharge port face of the ink jet recording head obtained by the process shown in FIGS. 9A1, 9A2, 9A3, 9A4, 9A5, 9A6, 9A7, 9A8, 9A9, 9A10 and 9A11.
Figure 10A:
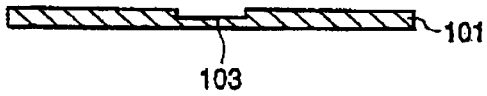
PRIOR ART FIG. 10A
FIGS. 10A, 10B, 10C, 10D, 10E, 10F, 10G, 10H and 10I are views showing steps of a conventional process for producing an ink jet recording head of edge shooter type.
Figure 10B:
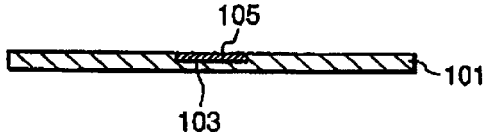
Figure 10C:
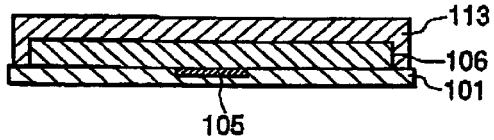
Figure 10D:
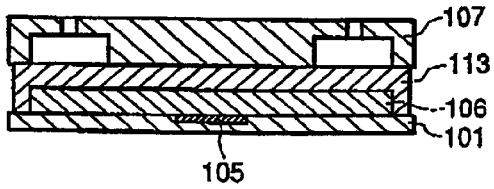
Figure 10E:
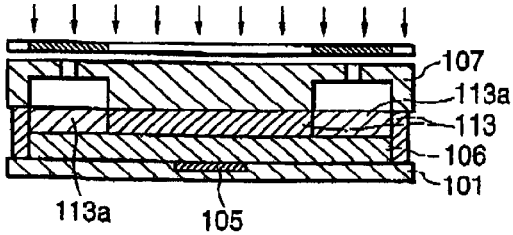
Figure 10F:
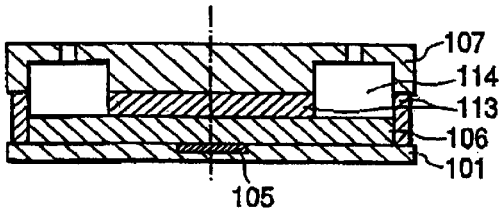
Figure 10G:
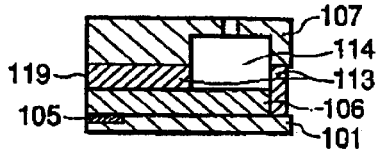
Figure 10H:
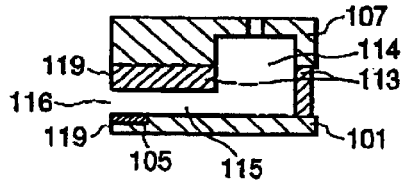
Figure 10I:
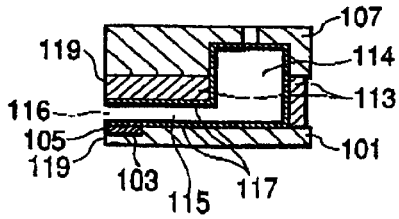

An example 5 is shown in FIGS. 9A1 to 9A11 and 9B. FIG. 9A1 to 9A5 are similar steps illustrated in FIGS. 5A to 5E.

At first, instead of the aluminum substrate 1*a* in the foregoing first or second example, there was employed a silicon substrate 1*b* bearing wirings, heaters and heat accumulation layers (FIG. 9A1).

Then patterning was performed by a multi-step exposure method disclosed in the Japanese Patent Application Laid-open No. 6-8437.

Positive photoresist AZ-4903 (Hoechst) was spin coated with a thickness of 40 $\mu$m and was prebaked for 40 minutes at 90° C. in an oven to form a solid layer 2. The solid layer 2 was subjected to a pattern exposure through a mask M2 of the nozzle pattern, by a Canon mask aligner PLA-501 with an exposure amount of 800 mJ/cm$^2$ (FIG. 9A2).

The photoresist was developed with 0.75 wt. % aqueous solution of sodium hydroxide, then rinsed with ion exchanged water and postbaked for 30 minutes at 50° C. in a vacuum oven to obtain a solid layer 2 developed to a depth of 20 $\mu$m (FIG. 9A3).

Then pattern exposure was executed through another mask M3, again with an exposure amount of 800 mJ/cm$^2$ (FIG. 9A4).

The photoresist was developed with 0.75 wt. % aqueous solution of sodium hydroxide, then rinsed with ion exchanged water and postbaked for 30 minutes at 70° C. in a vacuum oven to obtain a solid layer 2 (FIG. 9A5).

A Ta film 3 with a film thickness of 2 $\mu$m is formed by spattering (FIG. 9A6), which is different from a step of FIGS. 5A to 5K.

Next, a film formation is executed with a silicon oxide 8*d* of a thickness of not less than 20 $\mu$m by a high speed arc plasma film formation disclosed in Japanese Patent Application Laid-open No. 11-71681 (FIG. 9A7).

Ta is etched till an uppermost surface thereof is exposed by a chemical dry etcher CDE-7 supplied by Shibaura Mechatronics Corporation with $CF_4$: 300 sccm, $O_2$: 500 sccm, $N_2$: 50 sccm, gas pressure: 50 Pa (FIG. 9A8).

In this manner the surfacial Ta film was etched in the most protruding portion of the photoresist (FIG. 9A9).

Then the ink supply aperture 13 was formed by anisotropic etching from the rear side of the silicon substrate 1*b* (FIG. 9A10).

Then the substrate was immersed in 3.0 wt. % aqueous solution of sodium hydroxide to dissolve the solid layer 2 to form the liquid flow path 16, discharge port 10*a* and discharge port face 10 (FIG. 9A11).

FIG. 9B shows thus prepared head, observed from above.

In this manner there can be produced an ink jet recording head in which the discharge port face 10 is formed in the water-repellent settable resin layer above the silicon substrate 1*b*, and which is a side shooter ink jet recording head wherein the internal wall of the discharge port 10*a* alone is covered by the hydrophilic film 3.

What is claimed is:

1. A method for producing an ink jet recording head including a head member having a hydrophilically treated surface, comprising:

a first step for forming a solid layer having a surface for being hydrophilically treated;

a second step for forming a hydrophilic film with a side thereof in contact with said surface of said solid layer;

a third step for forming said head member on said hydrophilic film; and a fourth step for removing said solid layer to expose said side of said hydrophilic film.

2. A method according to claim 1, wherein said hydrophilic film formation is executed by sputtering, CVD or vapor deposition.

3. A method according to claim 1, wherein said hydrophilic film is composed of SiN, $SiO_2$, Al2O3, Ti, Ta, Cu, Ag or ITO.

4. A method according to claim 1, wherein said head member is formed of a material having an ink repellent property.

5. A method according to claim 4, wherein said head member material is composed of an ink-repellent settable resin.

6. A method according to claim 1, wherein said head member is formed of an inorganic material.

7. A method according to claim 1, wherein said head is of an edge shooter type in which an ink discharge port is provided on an end face of a head substrate.

8. A method according to claim 1, wherein said fourth step is executed after cutting through said head member, said film, and said layer.

9. A method according to claim 1, wherein said head is of a side shooter type in which an ink discharge port is provided above a head substrate.

10. A method according to claim 1, wherein said head member comprises material composed of resin and said fourth step is executed by dry etching.

11. A method according to claim 9, wherein said solid layer is provided with a discharge port pattern on a liquid flow path pattern.

12. An ink jet recording head which comprises a head produced by a method according to any of claims 1 to 11.

* * * * *

UNITED STATES PATENT AND TRADEMARK OFFICE

CERTIFICATE OF CORRECTION

PATENT NO. : 6,811,715 B2
DATED : November 2, 2004
INVENTOR(S) : Toshio Suzuki

It is certified that error appears in the above-identified patent and that said Letters Patent is hereby corrected as shown below:

Column 2,
Line 8, "hydroclophilizing" should read -- hydrophilizing --;
Line 12, "is" should read -- has --; and
Line 13, "hydrdophilicity" should read -- hydrophilicity --.

Column 7,
Line 31, "mJ/cm" should read -- $mJ/cm^2$ --.

Column 8,
Line 7, "is remained" should read -- remains --.

Column 10,
Line 7, "Al203," should read -- $Al_2O_3$, --.

Signed and Sealed this

Thirty-first Day of May, 2005

JON W. DUDAS
*Director of the United States Patent and Trademark Office*